United States Patent [19]

Bratzler et al.

[11] 4,011,066

[45] Mar. 8, 1977

[54] PROCESS OF PURIFYING GASES PRODUCED BY THE GASIFICATION OF SOLID OR LIQUID FOSSIL FUELS

[75] Inventors: Karl Bratzler, Bad Homburg; Alexander Doerges; Manfred Kriebel, both of Frankfurt am Main, all of Germany

[73] Assignee: Metallgesellschaft Aktiengesellschaft, Frankfurt am Main, Germany

[22] Filed: July 7, 1975

[21] Appl. No.: 593,915

[30] Foreign Application Priority Data

Jan. 29, 1975 Germany ..... 2503507

[52] U.S. Cl. ..... 55/44; 55/70; 55/73

[51] Int. Cl.[2] ..... B01D 19/00

[58] Field of Search ..... 55/40, 43, 44, 47, 48, 55/49, 63–65, 68–73; 423/226, 238, 243

[56] References Cited

UNITED STATES PATENTS

| | | | |
|---|---|---|---|
| 3,000,693 | 9/1961 | Schulte | 423/238 |
| 3,505,784 | 4/1970 | Hochgesand et al. | 55/44 |
| 3,738,086 | 6/1973 | Bellisio et al. | 55/48 |
| 3,880,615 | 4/1975 | Grunewald et al. | 55/44 |
| 3,899,312 | 8/1975 | Kruis et al. | 55/73 |
| 3,918,934 | 11/1975 | Kriebel et al. | 55/68 |

*Primary Examiner*—Bernard Nozick
*Attorney, Agent, or Firm*—Burgess, Dinklage & Sprung

[57] ABSTRACT

A process of purifying gases produced by a gasification of fossil fuels wherein the gas is cooled and scrubbed under superatmospheric pressures at normal temperatures while the raw gas, at a temperature of 150°–170° C, is indirectly cooled to ambient temperatures, the condensible hydrocarbons are separated and removed, the gas is scrubbed with water to remove ammonia in a first scrubbing stage in which the rate of water addition is controlled to be just sufficient to remove the ammonia, the gas is then scrubbed with a high-boiling organic solvent which is miscible with water and to which sulfur is added, the gas is subsequently scrubbed with the same solvent in a third scrubbing stage in which the water content of the solvent is kept at 5–30 mole percent $H_2O$ and in which $H_2S$ and COS are entirely removed from the gas, and the scrubbing agents from the second and third scrubbing stages are separately regenerated and recycled to the second and third scrubbing stages.

The scrubbing agent used in the second scrubbing stage is flashed approximately to atmospheric pressures, adding water, heating the scrubbing agent to the boiling temperature but not in excess of 170° C, treating the scrubbing agent in a stripping column with water vapor or stripping gas to remove liquid impurities, condensing the mixed vapors, isolating the condensates by phase separation, and feeding part of the aqueous phase as a reflux to the upper portion of the stripping column while the stripped scrubbing agent is cooled and is fed back to the top of the second scrubbing stage.

7 Claims, 2 Drawing Figures

PROCESS OF PURIFYING GASES PRODUCED BY THE GASIFICATION OF SOLID OR LIQUID FOSSIL FUELS

BACKGROUND

This invention relates to a process described in copending applications Ser. No. 593,818, filed July 7, 1975 which process is for purifying gases produced by a gasification of solid or liquid fossil fuels by a treatment with water vapor and oxygen under superatmospheric pressure, which process serves to remove catalyst-deteriorating impurities, such as mono- or polyunsaturated hydrocarbons, mercaptans, HCN, HCl, $H_2S$, $CS_2$, COS, and $NH_3$, and to desulfurize the gas, so as to produce an exhaust gas which is rich in $H_2S$, and comprises cooling and scrubbing the gas under superatmospheric pressure and at normal temperature.

The process of the copending application is characterized in that the raw gas, at a temperature of 150°–170° C, is indirectly cooled to ambient temperature, the condensible hydrocarbons are separated and removed, the gas is subsequently scrubbed with water to remove ammonia in a first scrubbing stage, in which the rate of water addition is controlled to be just sufficient to remove the ammonia, the gas is then scrubbed with a highboiling organic solvent, which is miscible with water and to which sulfur is added, in a second scrubbing stage, in which the rate of solvent addition is controlled in dependence on the solubility of the methylmercaptan, which is to be removed, in the solvent, the gas is subsequently scrubbed with the same solvent in a third scrubbing stage, in which the water content of the solvent is kept at 5–30 mole percent $H_2O$ and in which $H_2S$ and COS ar entirely and selectively removed from the gas, and the scrubbing agents from the second and third scrubbing stages are separately regenerated and recycled to the second and third scrubbing stages for re-use.

According to additional features, sulfur is added to the scrubbing agent in the second scrubbing stage in an amount of 0.1 to 10 g, preferably 3 to 8 g, per liter of scrubbing liquid.

The sulfur may be formed in that the hydrogen sulfide contained in the gas which leaves the first scrubbing stage is reacted with the oxygen which is present in the gas so that the oxygen is simultaneously removed from the gas, and in that a soluble activator, preferably a compound which has a boiling point which is approximately as high as, or higher than the high-boiling organic solvent, is added to the scrubbing agent of the third scrubbing stage. A basic nitrogen-containing organic solvent may be used as an activator, e.g., an imidazole derivative, such as 1,2-dimethylimidazole in quantities of 1–10% by weight, preferably 5–15% by weight.

Pyrrolidone or a derivative of pyrrolidone, preferably N-methylpyrrolidone, or polyglycolether, Sulfolan, butyrolactone, morpholine and/or N-methyl- $\epsilon$-caprolactam, has been used as a high-boiling organic solvent within the scope of the invention.

The laden scrubbing agents in the second and third scrubbing stages are regenerated by being flashed, possibly with a supply of heat, and by being subsequently stripped with water vapor or inert gas or inert gas and/or being subjected to a vacuum as far as the laden scrubbing agent of the third scrubbing stage is concerned. The regenerated scrubbing agents are recycled in a cycle.

The advantages afforded by the invention of the copending application reside mainly in that the gases produced by a gasification of solid or liquid fuels cannot only be purified but can be selectively desulfurized at the same time.

The gas if first scrubbed with water to remove ammonia. In the second scrubbing stage, an organic solvent is used to remove all catalyst poisons except for $H_2S$ and COS. These two constituents are finally removed in a third stage. The scrubbing agent requirement is low.

The resulting pure gas may be used for chemical syntheses, e.g., for the production of ammonia, methane, methanol, oxo products or Fischer-Tropsch products. The exhaust gas from the third stage is so highly enriched with hydrogen sulfide that it can be processed by the Claus process to produce elementary sulfur.

SUMMARY

This invention relates to development of the process in the copending application and resides in a special process for regenerating the scrubbing agents, particularly the scrubbing agent of the second scrubbing stage.

The process of this invention is characterized in that the scrubbing agent which has been used in the second scrubbing stage is flashed approximately to atmospheric pressure, water is added, if desired, and the scrubbing agent is then heated to the boiling temperature but not in excess of 170° C and is then treated in a stripping column with water vapor or stripping gas to remove the liquid impurities, whereafter the mixed vapors are condensed, the condensates are isolated by phase separation, and part of the aqueous phase is fed as a reflux to the upper portion of the stripping column whereas the stripped scrubbing agent is cooled and is fed back to the top of the second scrubbing stage.

DESCRIPTION

Figure 1:
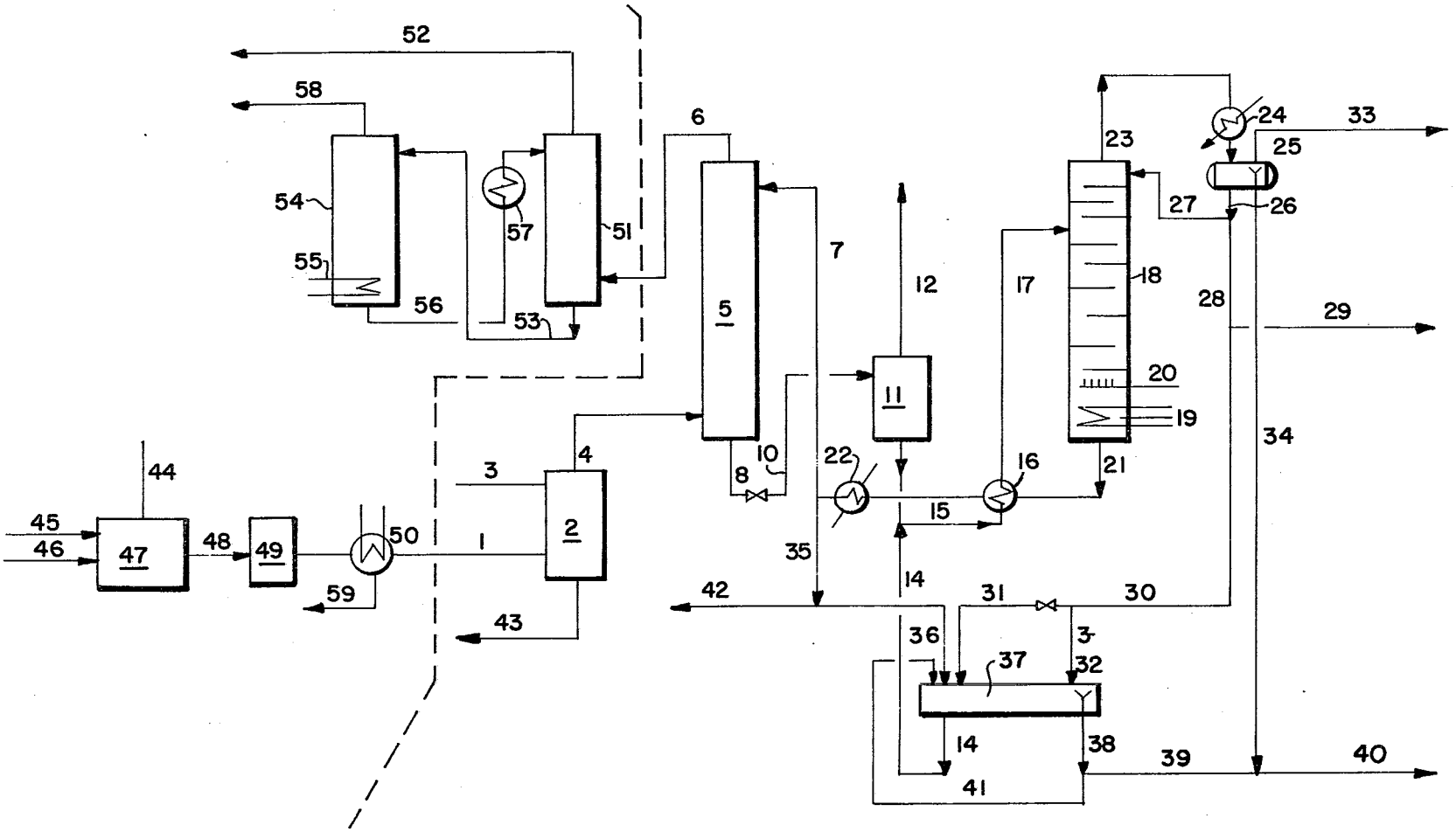
FIG. 1 illustrates the purification process.
Figure 2:
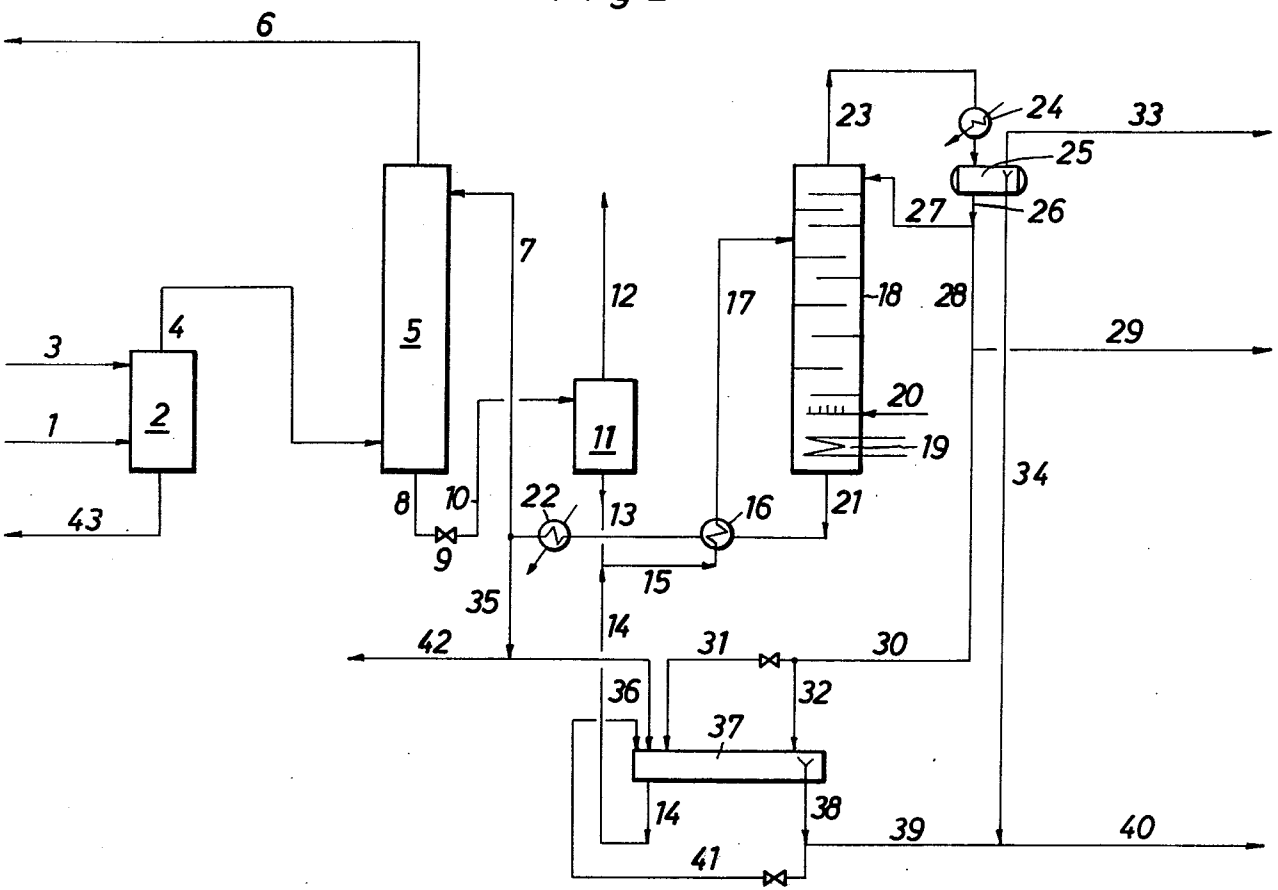
FIG. 2 illustrates reactor plus purification process with additional scrubbing of gas.

According to a further feature of the invention, part of the scrubbing agent which is circulated through the second scrubbing stage is withdrawn from circulation when said scrubbing agent has been flashed, the volatile impurities have been stripped off at elevated temperatures, and the scrubbing agent has been cooled, the withdrawn part of the scrubbing agent is subjected to liquid-liquid extraction with water to remove water-insoluble constituents, the water-insoluble constituents are separated, and the water with which the scrubbing agent has been diluted is distilled off to strengthen the scrubbing agent, which is then fed back into the main cycle.

According to a further feature of the process of the invention, the scrubbing agent which has been circulated through the second scrubbing stage is flashed, stripped at elevated temperatures up to 170° C to remove the volatile impurities, and cooled to 20°–50° C, at least 20% by volume and up to 200% by volume water are added, a liquid phase which is water-insoluble is separated, the solvent is then extracted with water from part of the scrubbing agent and the remaining mixture of scrubbing agent and water is added to the scrubbing agent from the second scrubbing stage before or after it has entered the stripping column.

When the scrubbing agent circulated through the second scrubbing stage has been flashed and has been stripped at elevated temperatures up to 170° C to remove the volatile impurities, part of the scrubbing agent is suitable branched off and is cooled to 20°–50° C, at least 20% by volume and up to 200% by volume water, which has been formed by condensation from the vapors from the stripping column, are added, a water-insoluble phase is separated, solvent contained in said phase is extracted with part of the added water, and the remaining mixture of scrubbing agent and water is added to the scrubbing agent from the second scrubbing stage before or after it has entered the stripping column.

According to a preferred feature, the water-diluted scrubbing agent which has been subjected to liquid extraction is heated to distill off a major amount of the water, the vapor are fed into the lower portion of the stripping column and the distillation residue is cooled and is fed to the top of the second scrubbing stage.

N-methylpyrrolidone or another N-alkylated lactam is used within the scope of the invention as a scrubbing agent in the second and following scrubbing stages.

A polyalkyleneglycoldimethylether or another water-soluble glycolether having a boiling point above 200° C has also proved suitable.

EXAMPLE 1

In accordance with the accompanying drawing, gas produced by a pressure gasification of coal and composed of

| | | |
|---|---|---|
| 28.2% | by volume $CO_2$ | |
| 0.65% | by volume $C_nH_m$ | (inclusive of 8.9 g/standard m³ hydrocarbons boiling in the range of 40–125° C) |
| 0.1 % | by volume $O_2$ | |
| 20.8 % | by volume CO | |
| 39.2 % | by volume $H_2$ | |
| 9.7 % | by volume $CH_4$ | |
| 1.0 % | by volume $N_2$ | |
| 0.35 % | by volume $H_2S$ | |
| 256 | mg/standard m³ organic sulfur compounds | |
| 10 | mg/standard HCN | |
| 16 | mg/standard $NH_3$ | |

is to be desulfurized and to be purified to be free of catalyst poisons.

The gas is under a pressure of 25 bars. It is produced in the reactor 47 from fossil fuel entering through line 44 and from steam supplied through line 45 and oxygen through line 46. The hot gases pass through line 48 to the cooler 49 and then to another indirect cooler 50. It is separated from the condensate which is withdrawn through line 59. Then 100,000 standard M³/h of the gas are fed through conduit 1 to scrubber 2 and to remove the ammonia are scrubbed in the scrubber 2 with 5 m³/h water fed through conduit 3 and flowing in a countercurrent. The $NH_3$-containing water is drained through conduit 43.

The gas then flows through conduit 4 into the scrubbing tower 5 and is scrubbed therein with 38 m³/h N-methylpyrrolidone, which contains 680 kg water and is fed through conduit 7 and flows in a countercurrent. The gas leaves the scrubbing tower through conduit 6 and is fed to the third scrubbing stage 51. The scrubbed gas is leaving the third scrubbing stage via conduit 52. In the third scrubbing stage the gas is contacted with 270 m³/h N-methylcyrrolidone which flows in a counter-current and which contains 10 mol percent $H_2O$ and 8% by weight, 1,2 dimethylimidazole as an activator. COS is hydrolized to form $H_2S$ and $CO_2$ by the coaction of water and activator. $H_2S$ is dissolved in the rich solvent which flows from the scrubber 51 through line 53 to the regenerator 54. There the rich solvent is regenerated by indirect heating means 55. The regenerated solvent returns to the scrubber 51 via line 56 and cooler 57. The off gas, rich in $H_2S$ , is fed through line 58, to further treatment. In the scrubbing tower 5, the scrubbing agent removes water vapor from the gas as well as, with the exception of $H_2S$ and COS, all catalyst-deteriorating impurities, particularly 890 kg/h hydrocarbons and 20.8 kg/h sulfur as organic sulfur compounds. Elementary sulfur dissolved in the scrubbing agent is formed from the $H_2S$ and oxygen contained in the gas. As a result, gaseous constituents react with the elementary sulfur in the scrubbing agent and are preferentially removed by chemical combination and conversion. This remark is particularly applicable to mercaptans, which are reacted to form disulfides and hydrogen sulfide, and is also applicable to HCN and $NH_3$, which form ammonium rhodanide $NH_4SCN$, if the preceding scrubber 2 for removing $NH_3$ is not operated or is not operated to remove all $NH_3$. Other gaseous constituents are physically dissolved in the scrubbing agent. The laden scrubbing agent is drained through conduit 8 and is flashed through the pressure relief valve 9 and flows through conduit 10 into the flasher 11, where the scrubbing agent can release all gas. The released gases are exhausted through conduit 12. The scrubbing agent leaves through conduit 13. A partial stream from conduit 14 is added to the scrubbing agent and consists of 2 m³/h regenerated scrubbing agent and 3640 kg/h water from extractor 37. The mixture flows through conduit 15, heat exchanger 16, and conduit 17 to the top of stripping column 18. The same is indirectly heated in its lower portion by the heater 19, 3.g., a reboiler, to maintain a sump temperature of 165° C. Besides, 3500 kg/h superheated steam of 165° C flow through conduit 20 into the lower portion of the stripping column and upwardly in a countercurrent to the scrubbing agent. The stripped scrubbing agent still contains 720 kg/h water and 450 kg/h hydrocarbons. It leaves the stripping column through conduit 21 and is cooled in heat exchanger 16 and cooler 22. 34 m³/h then flow through conduit 7 back to the scrubber 5 and 2 m³/h are supplied through conduits 35 and 36 to the extractor 37.

Vapors leave the top of stripping column 18 through conduit 23. They consist mainly of 14,400 kg/h water vapor, 865 kg/h hydrocarbons, and 19.7 kg/h S in the form of organic sulfur compounds and also contain some $H_2S$, COS, $CO_2$ and inert gaseous constituents. The vapors are partially condensed in condenser 24 and are separated in the separator 25 into two liquid phases (water and hydrocarbons + S compounds) and remaining gases. The remaining gases flow out through conduit 33. The condensed water is drained through conduit 26. 7200 kg/h are refluxed through conduit 27 to the stripping column. The remaining 7200 kg/h flow through the conduit 28. They are then divided into 3600 kg/h water discharged through conduit 29 and additional 3600 kg/h water which are first conducted through conduit 30 to the extractor 37. The latter is supplied with 3400 kg/h $H_2O$ added to the main flow supplied to the extractor (from conduits 35 and 36) and with 200 kg/h $H_2O$ through conduit 32. The latter stream serves to dissolve the remaining water-soluble scrubbing agent out of the hydrocarbons before they leave the extractor through conduit 38. Part of the hydrocarbons may be fed through conduit 41 back to the inlet of the extractor to form a "receiving phase" if hydrocarbons become available at a low rate and to facilitate the separation from the aqueous phase. 25 kg/h hydrocarbons and 1.1 kg/h sulfur in the form of dissolved organic sulfur compounds are discharged through conduit 39. They are united with 865 kg/h hydrocarbons and 19.7 kg/h sulfur from conduit 34 so that 890 kg/h hydrocarbons and 20.8 kg/h organic sulfur leave the plant through conduit 40. This corresponds to the quantities scrubbed from the gas per hour in the scrubber 5. The mixture of N-methylpyrrolidone and water from which the hydrocarbons and organic sulfur compounds have been removed leaves the extractor through conduit 14 and is added in conduit 15 to the laden scrubbing agent.

If the $NH_3$-removing scrubber 2 is not in operation, the water discharged through conduit 29 will contain also the volatile ammonia and HCN, which in this case has also been removed in the scrubber 5. The ammonia which is not volatile at elevated temperatures will then be contained in the regenerated scrubbing agent from stripping column 18. To remove this ammonia too, a branch stream may be fed through conduits 35 and 42 to a reclaimer (not shown), in which the scrubbing agent consists of N-methylpyrrolidone can be recovered by distillation and condensation, whereas the fixed ammonia compounds and other impurities of low volatility remain in the residue and are discarded.

In a special embodiment of the invention, the water which has been withdrawn through conduit 29 may be used to scrub off ammonia in the scrubber 2. This will reduce the rate at which water must be supplied through conduit 3 by 3600 kg/h to 1400 kg/h. The water from conduit 29 is suitably fed to the scrubber 2 below the inlet 3.

EXAMPLE 2

The gas has the same composition as in EXAMPLE 1. In accordance with FIG. 1, 100,000 standard $m^3/h$ under a pressure of 25 bars are fed through conduit 1 to scrubber 2 and to remove ammonia are scrubbed in the scrubber 2 with 5 $m^3/h$ water supplied through conduit 3 and flowing in a countercurrent. The gas then flows through conduit 4 into the scrubbing tower 5 and is scrubbed with polyethyleneglycoldimethylether, which contains 1170 kg $H_2O$ and which is supplied through conduit 7 and flows in a countercurrent to the gas. The gas then leaves the scrubbing tower and is fed to another scrubber (not shown) for a removal of $H_2S$ and COS. In the scrubbing tower 5 the scrubbing agent takes up water vapor from the gas and, with the exception of $H_2S$ and COS, all catalyst-deteriorating impurities, particularly 890 kg/h hydrocarbons and 20.8 kg/h sulfur in the form of the organic sulfur compounds. Besides, elementary sulfur which is dissolved in the scrubbing agent is formed from the $H_2S$ and oxygen contained in the gas so that particularly mercaptans can be more easily removed from the gas. The laden scrubbing agent contains also physically dissolved gas constituents. The scrubbing agent is drained through conduit 8 and flows through the pressure relief valve 9 and conduit 10 into the flasher 11. The flashed-off gases leave through conduit 12. The scrubbing agent is drained through conduit 14. A partial stream from conduit 14 is admixed to the scrubbing agent and consists of 10 $m^3/h$ of a mixture of regenerated scrubbing agent and 7930 kg/h water from extractor 37.

The water-containing scrubbing agent is fed through conduit 15, heat exchanger 16 and conduit 17 to the stripping column 18, which in its lower portion is indirectly heated to 168° C by the heater 19. Superheated steam may also be introduced through conduit 20, if required. The stripped scrubbing agent still contains 1200 kg/h water and 800 kg/h hydrocarbons. It leaves the stripping column through conduit 21 and is cooled in heat exchanger 16 and in cooler 22. 78 $m^3/h$ are then fed through conduit 7 back to the scrubber 5, whereas 2 $m^3/h$ are fed through conduits 35 and 36 to the extractor 37.

The vapors leave the top of stripping column 18 through conduit 23 and consist mainly of 16,000 kg/h water vapor, 870 kg/h hydrocarbons, and 20.0 kg/h S in the form of organic sulfur compounds and also contain some $H_2S$, COS, $CO_2$ and inert gaseous constituents. The vapors are partially condensed in condenser 24 and are separated into two liquid phases and remaining gases in the separator 25. The remaining gases leave through conduit 33. The condensed water is drained through conduit 26. 8000 kg/h are fed through conduit 27 to the top of the stripping column 18 as a reflux. The remaining 8000 kg/h flow through the conduit 28 and are then divided into 100 kg/h water which are discharged through conduit 29 and additional 7900 kg/h water which are initially fed through conduit 30 to extractor 37. At the latter, 7720 kg/h $H_2O$ are added through conduit 31 to the main flow (from conduits 35 and 36) to the extractor, and 180 kg/h $H_2O$ are added through conduit 32. The latter stream serves to dissolve remaining water-soluble scrubbing agent from the hydrocarbons before they leave the extractor through conduit 38.

Part of the hydrocarbons may be fed through conduit 41 back to the inlet of the extractor and, if hydrocarbons become available at a low rate, may form a "receiving phase" and may facilitate the separation from the aqueous phase. 20 kg/h hydrcarbons and 0.8 kg/h sulfur in the form of organic sulfur compounds are discharged through conduit 39. They are united with 870 kg/h hydrocarbons and 20.0 kg/h sulfur from conduit 34 so that 890 kg/h hydrocarbons and 20.8 kg/h sulfur leave the plant through conduit 40.

The mixture of water and polyethyleneglycoldimethylether (10 $m^3/h$) from which the hydrocarbons and organic sulfur compounds have been removed leaves the extractor through conduit 14 and is admixed to the laden scrubbing agent in conduit 15.

What is claimed is:

1. In a process of purifying gases produced by a gasification of fossil fuels by treatment with water vapor and oxygen under superatmospheric pressures to remove catalystdeteriorating impurities, such as mono- and polyunsaturated hydrocarbons, mercaptans, HCN, HCl, $H_2S$, $CS_2$, COS, and $NH_3$, and to desulfurize the gas, to produce an exhaust gas which is rich in $H_2O$, wherein the gas is cooled and scrubbed under superatmospheric pressures at normal temperatures while the raw gas, at a temperature of 150°–170° C, is indirectly cooled to ambient temperatures, the condensible hydrocarbons are separated and removed, the gas is scrubbed with water to remove ammonia in a first scrubbing stage in which the rate of water addition is controlled to be just sufficient to remove the ammonia, the gas is then scrubbed with a highboiling organic solvent which is miscible with water and to which sulfur is added, in a second scrubbing stage in which the rate of solvent addition is controlled in dependence on the solubility of the methylmercaptan, which is to be removed, in the solvent, the gas is subsequently scrubbed with the same solvent in a third scrubbing stage in which the water content of the solvent is kept at 5–30 mole percent $H_2O$ and in which $H_2S$ and COS are entirely and selectively removed from the gas, and the scrubbing agents from the second and third scrubbing stages are separately regenerated and recycled to the second and third scrubbing stages for re-use, the improvement which comprises flashing the scrubbing agent used in the second scrubbing stage approximately to atmospheric pressures, adding water, if desired, heating the scrubbing agent to the boiling temperature but not in excess of 170° C, treating the scrubbing agent in a stripping column with water vapor or stripping gas to remove liquid impurities, condensing the mixed vapors, isolating the condensates by phase separation, and feeding part of the aqueous phase as a reflux to the upper portion of the stripping column while the stripped scrubbing agent is cooled and is fed back to the top of the second scrubbing stage.

2. Process of claim 1 wherein part of the scrubbing agent which is circulated through the second scrubbing stage is withdrawn from circulation when said scrubbing agent has been flashed, the volatile impurities have been stripped off at elevated temperatures, and the scrubbing agent has then been cooled, the withdrawn part of the scrubbing agent is subjected to liquid-liquid extraction with water to remove water-insoluble constituents, the water-insoluble constituents are separated, and the water with which the scrubbing agent has been diluted is distilled off to strengthen the scrubbing agent, which is then fed back into the main cycle.

3. Process of claim 1 wherein the scrubbing agent which has been circulated through the second scrubbing stage is flashed, stripped at elevated temperatures up to 170° C to remove the volatile impurities, and cooled to 20°–50° C, at least 20% by volume and up to 200% by volume water are added, a liquid phase which is water-insoluble is separated, the solvent is then extracted with water from part of the scrubbing agent and the remaining mixture of scrubbing agent and water is added to the scrubbing agent from the second scrubbing stage before or after it has entered the stripping column.

4. Process of claim 1 wherein the scrubbing agent circulated through the second scrubbing stage is flashed and is stripped at elevated temperatures up to 170° C to remove the volatile impurities, and part of the scrubbing agent is then branched off and is cooled to 20°–50° C, at least 20% by volume and up to 200% by volume water, which has been formed by condensation from the vapors from the stripping column, are added, a water-insoluble phase is separated, solvent contained in said phase is extracted with part of the added water, and the remaining mixture of scrubbing agent and water is added to the scrubbing agent from the second scrubbing stage before or after it has entered the stripping column.

5. Process of claim 1 wherein the water-diluted scrubbing agent which has been subjected to liquid extraction is heated to distill off a major amount of the water, the vapors are fed into the lower portion of the stripping column and the distillation residue is cooled and is fed to the top of the second scrubbing stage.

6. Process of claim 1 wherein N-methylpyrrolidone or another N-alkylated lactam is used as a scrubbing agent in the second and following scrubbing stages.

7. Process of claim 1 wherein a polyalkyleneglycoldimethylether or another water-soluble glycolether having a boiling point below 200° C is used as a scrubbing agent in the second and following scrubbing stages.

* * * * *